United States Patent [19]

Makino et al.

[11] Patent Number: 4,840,862

[45] Date of Patent: Jun. 20, 1989

[54] PHOTOCONDUCTIVE COMPOSITION HAVING AN AZAAZULENIUM SALT

[75] Inventors: Naonori Makino; Takanori Hioki; Yoshio Inagaki; Seiji Horie, all of Kanagawa, Japan

[73] Assignee: Fuji Photo Film Co., Ltd., Kanagawa, Japan

[21] Appl. No.: 82,462

[22] Filed: Aug. 7, 1987

[30] Foreign Application Priority Data

Aug. 7, 1986 [JP] Japan ..... 61-184325

[51] Int. Cl.[4] ..... G03G 5/09; G03G 5/14

[52] U.S. Cl. ..... 430/75; 430/76; 430/78; 430/72

[58] Field of Search ..... 430/58, 59, 72, 73, 430/74, 75, 76, 78, 83, 90, 91, 95, 945

[56] References Cited

U.S. PATENT DOCUMENTS 4,565,761 1/1986 Katagiri et al. ..... 430/75

4,629,670 12/1986 Katagiri et al. ..... 430/78

4,673,630 6/1987 Katagiri et al. ..... 430/75

*Primary Examiner*—John L. Goodrow

*Attorney, Agent, or Firm*—Sughrue, Mion, Zinn, Macpeak & Seas

[57] ABSTRACT

A photoconductive composition containing at least one of azaazulenium salt compounds represented by the following formula (I):

(I)

wherein $R_1$, $R_2$, $R_3$, $R_4$, $R_5$ and $R_6$ each represents a hydrogen atom, a halogen atom, a hydroxyl group, a nitro group, a carboxyl group, a sulfonic acid group, a mercapto group or a monovalent organic residue; A represents a divalent organic group bonded by the double bond; $X^{\ominus}$ represents an anionic group; n is the number of $X^{\ominus}$ groups required to balance the positive charge; provided that each $X^{\ominus}$ group may be bonded to any of $R_1$, $R_2$, $R_3$, $R_4$, $R_5$, $R_6$ or A to form an inner salt; and any two of $R_2$, $R_3$, $R_4$, $R_5$ and $R_6$ bonded to adjacent carbon atoms may be linked to form a substituted or unsubstituted aromatic carbocyclic or aromatic heterocyclic ring. The photoconductive composition provides an electrophotographic photoreceptor having high sensitivity and stable charging properties even after long use.

19 Claims, No Drawings

PHOTOCONDUCTIVE COMPOSITION HAVING AN AZAAZULENIUM SALT

FIELD OF THE INVENTION

The present invention relates to photoconductive compositions containing novel azaazulenium salt compounds.

BACKGROUND OF THE INVENTION

As disclosed in U.S. Pat. No. 2,297,691 to Carlson, an electrophotographic process employs a photoconductive material comprising a substrate which has been coated in a dark room with an insulating material which changes its electrical resistance depending on the amount of irradiation during imagewise exposure. Such a photoconductive material is generally given a uniform surface electrical charge after being adapted to darkness for a suitable period of time. The material is then exposed to a desired image by an irradiation pattern which has an effect of reducing surface electrical charge depending on relative energy contained in various portions of the irradiation pattern. The surface electrical charge or static latent image thus left behind on the surface of the photoconductive material layer (electrophotographic photosensitive layer) is then brought into contact with a suitable electroscopic displaying substrane or toner to develop a visible image.

Such a toner may be contained in either an insulating liquid or dry carrier. In either case, the toner may be attached to the surface of an electrophotographic photosensitive layer in accordance with an electrical charge pattern. The displaying substance thus attached may be fixed to the layer by a known means such as heat, pressure, and solvent vapor. The static latent image may be transferred to a second substrate (e.g., paper and film). Accordingly, the static latent image may be developed on such a second substrate.

Principle requirements in an electrophotographic process include that (1) the photoconductive material can be charged with a desired potential in a dark room, (2) the dissipation of electrical charge in a dark room is negligibly small, and (3) the electrical charge can be rapidly dissipated upon light irradiation.

Heretofore, photoconductive materials for electrophotographic photoreceptor that have been employed include selenium, cadium sulfide, and zinc oxide.

It is known that these inorganic materials have many advantages but, at the same time, have many disadvantages. For example, selenium, which is now widely used, satisfies the above requirements but is disadvantageous in that its complex production conditions entail high production costs. This material is also disadvantageous in that its poor flexibility makes it difficult to be worked into a belt-shaped form, and its high susceptibility to heat and mechanical impact requires careful handling. Cadmium sulfide or zinc oxide is dispersed in a binder such as a resin to be used as an electrophotographic photoreceptor. However, such an electrophotographic photoreceptor is disadvantageous in mechanical properties such as smoothness, rigidity, tensile strength, and abrasion resistance, and thus can not sufficiently repeatedly be used in its heretofore known embodiments.

In recent years, electrophotographic photoreceptors employing various organic materials have been proposed and put into practical use to eliminate these problems of inorganic materials. These electrophotographic photoreceptors include an electrophotographic photoreceptor made of poly-N-vinylcarbazole and 2,4,7-trinitrofluorene (see U.S. Pat. No. 3,484,237), an electrophotographic photoreceptor which comprises poly-N-vinyl carbazole sensitized with a pyrylium salt dye (see Japanese Patent Publication No. 25658/73), an electrophotographic photoreceptor mainly comprising an organic pigment (see Japanese Patent Application (OPI) No. 37543/72 (the term "OPI" as used herein refers to a "published unexamined Japanese patent application")), and an electrophotographic photoreceptor mainly comprising an eutectic complex made of a dye and a resin (see Japanese Patent Application (OPI) No. 10735/72).

If a proper binder is selected, an electrophotographic photoreceptor employing such an organic material can be applied to a substrate by a coating method. Therefore, such an electrophotographic photoreceptor provides an extremely high productivity, providing an inexpensive photoreceptor. Such an electrophotographic photoreceptor has improved mechanical properties and flexibility. Furthermore, when a dye and an organic pigment are properly selected, the photosensitive wavelength can freely be controlled. However, these electrophotographic photoreceptors cannot fully meet requirements for electrophotographic photoreceptor since they are low in photosensitivity and are not suitable for repeated use.

SUMMARY OF THE INVENTION

An object of the invention is to provide photoconductive compositions useful in various photoconductive materials.

A further object of the invention is to provide electrophotographic photoreceptors that are high in sensitivity and have stable electric potential properties even after repeated use.

The inventors have studied earnestly to overcome the disadvantages found in the above conventional electrophotographic photoreceptors and to develop such photoreceptors with a sensitivity and a durability high enough to be used in practice, and have found that these and other objects of the present invention can be attained by electrophotographic photoreceptors containing photoconductive compositions that contain novel azaazulenium salt compounds.

Accordinly, the present invention provides a photoconductive composition containing at least one azaazulenium salt compound represented by the following formula (I)

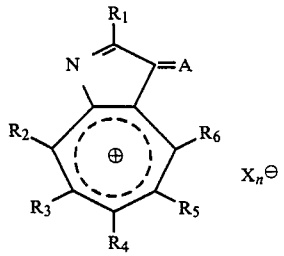

(I)

wherein $R_1$, $R_2$, $R_3$, $R_4$, $R_5$ and $R_6$, which may be the same or different, each represents a hydrogen atom, a halogen atom, a hydroxy group, a nitro group, a carboxyl group, a sulfonic acid group, a mercapto group, or a monovalent organic group; A represents a divalent organic group bonded by the double bond; $X\ominus$ represents an anionic group; n is the number of X⊖ groups required to balance the positive charge; provided that each X⊖ group may be bonded to any of $R_1$, $R_2$, $R_3$, $R_4$, $R_5$, $R_6$ or A to form an inner salt; and any two of $R_2$, $R_3$, $R_4$, $R_5$ and $R_6$ bonded to adjacent carbon atoms may be linked to form a substitute or unsubstituted aromatic carbocyclic or aromatic heterocyclic ring.

DETAILED DESCRIPTION OF THE INVENTION

Azaazulenium salt compounds according to the invention are described hereinafter in detail.

In compounds represented by formula (I), preferably $R_1$, $R_2$, $R_3$, $R_4$, $R_5$ and $R_6$ each represents a hydrogen atom, a halogen atom (F, Cl, Br and I), a hydroxy group, a nitro group, a carboxyl group, a sulfonic acid group, a mercapto group or a monovalent organic group having 1 to 30 carbon atoms, including a substituted or unsubstituted alkyl group (e.g., methyl, ehtyl, n-propyl, isopropyl, n-butyl, t-butyl, n-amyl, t-amyl, n-hexyl, n-octyl, t-octyl, 2-ethylhexyl, cyclohexyl, 2-methoxyethyl, 2-phenoxyethyl and n-hexadecyl), a substituted or unsubstituted aryl group (e.g., phenyl, tolyl,xylyl, ethylphenyl, methoxyphenyl, ethoxyphenyl, chlorphenyl, nitrophenyl, dimethylaminophenyl, α-naphthyl, β-naphthyl and n-dodecylphenyl), a substituted or unsubstituted heterocyclic ring group (e.g., pyridyl, quinolyl, carbazolyl, furyl, thienyl, pyrazolyl, benzotriazolyl, indazolyl benzoxazolyl, benzothiazolyl, benzimidazolyl and 5-phenylbenzothiazolyl), a substituted or unsubstituted aralkyl group (e.g., benzyl, 2-phenylethyl, 2-phenyl -1-methylethyl, bromobenzyl, 2-bromophenylethyl, methylbenzyl, methoxybenzyl, nitrobenzyl, cyanobenzyl and 4-dodecylbenzyl), an acyl group (e.g., acetyl, propionyl, butyryl, valeryl, pivaloyl, benzoyl, toluoyl, naphthoyl, phthaloyl, furoyl, trifluoroacetyl, 2-ethyl -hexanoyl, 2-(2,4-di-tert-aminophenoxy)butyryl and stearoyl), a substituted or unsubstituted amino group (e.g., methylamino, dimethylamino, diethylamino, dipropylamino, acetylamino, benzoylamino, stearoylamino, di(2-hydroxyethyl) amino, ethyl-2-methanesulfonamidoethylamino, morpholino, pyrrolidino, piperidino, methylsulfonylamino and p-dodecylbenzenesulfonylamino), a substituted or unsubstituted styryl group (e.g., styryl, dimethylaminostyryl, diethylaminostyryl, dipropylaminostyryl, methoxystyryl, ethoxystyryl and methylstyryl), a substituted or unsubstituted alkoxy group (wherein the alkyl group has the same definition as the alkyl group above), a substituted or unsubstituted alkylthio group (wherein the alkyl group has the same definition as the alkyl group above), a substituted for unsubstituted arylthio group (wherein the aryl group has the same definition as the aryl group above), a substituted or unsubstituted heterocyclic thio group (e.g., 2-pyridylthio, 2-quinolylthio, 2-benzoxazolylthio, 2-benzothiazolylthio, 1,3-diethylbenzimidazole -2-thioyl, 5-phenylbenzothiazole-2-thioyl), 1-phenyltetrazole-2-thioyl and 1-phenylimidazole-2-thioyl), a substituted or unsubstituted carbamoyl group (e.g., a carbamoyl group, a methylcarbamoyl group, a diethylcarbamoyl group, a phenylcarbamoyl group, a hexadecylcarbamoyl group and a 2-(3-phenylureido ethylcarbamoyl group), a substituted or unsubstituted alkoxycarbonyl group (e.g., an ethoxycarbonyl group, a 2-hydroxyethoxy carbonyl group, a hexadecyloxycarbonyl group and a 2-dodecyloxyethoxycarbonyl group), a substituted or unsubstituted aryloxycarbonyl group (e.g., a phenoxycarbonyl group, a methoxyphenoxycarbonyl group, a nitrophenoxycarbonyl group, a 2,4-di-tert-amylphenoxycarbonyl group and a p-dodecylphenoxycarbonyl group) or a substituted or unsubstituted arylazo group (e.g., phenylazo, α-naphthylazo, β-naphthylazo, dimethylaminophenylazo, chlorophenylazo, nitrophenylazo, methoxyphenylazo, tolylazo, sulfamoylphenylazo, hexadecylphenylazo and dodecyloxycarbonylphenylazo).

Preferred groups represented by $R_1$ include a hydrogen atom, a hydroxy group, a halogen atom (e.g., F, cl, Br and I), a substituted or unsubstituted alkyl group having 1 to 20 carbon atoms (e.g., methyl, ethyl, n-propyl, isopropyl, n-butyl, t-butyl, n-amyl, t-amyl, n-hexyl, n-octyl, t-octyl, 2-ethylhexyl, cyclohexyl, 2-methoxyethyl, 2-phenoxyethyl and n-hexadecyl), a substituted or unsubstituted alkoxy group having 1 to 10 carbon atoms (e.g., a methoxy group, a propoxy group, a phenoxy group and a benzyloxy group), a substituted or unsubstituted phenyl group having 6 to 20 to carbon atoms (e.g., phenyl, tolyl, xylyl, ethylphenyl, methoxyphenyl, ethoxyphenyl, chlorophenyl, nitrophenyl, dimethylaminophenyl, t-amylphenyl and dodecylphenyl), —$OCOR_7$ (wherein $R_7$ represents a substituted or unsubstituted aryl group, a substituted or unsubstituted aryl group or a substituted or unsubstituted aralkyl group, each of which contains up to 20 carbon atoms) and a substituted or unsubstituted amino group (e.g., a methylamino group, a dimethylamino group, an ethylamino group, a diethylamino group, a diphenylamino group, a morpholino group, a pyrrolidino group, a piperidino group and a methylsulfonylamino group).

Particulary preferred groups represented by $R_2$, $R_3$, $R_4$, $R_5$ and $R_6$ include a hydrogen atom, a halogen atom (e.g., F, Cl, Br and I), a substituted or unsubstituted alkyl group having 1 to 20 carbon atoms (e.g., methyl, ethyl, n-propyl, isopropyl, n-butyl, t-butyl, n-amyl, t-amyl, n-hexyl, cyclohexyl, t-octyl, n-octyl, 2-ethylhexyl, 2-methoxyethyl, 2-phenoxyethyl and n-hexyldecyl) or a substituted or unsubstituted phenyl group having 6 to 20 carbon atoms (e.g., phenyl, tolyl, xylyl, ethylphenyl, methoxyphenyl, ethoxyphenyl, chlorophenyl, nitrophenyl, dimethylaminophenyl, t-amylphenyl and dodecylphenyl).

Examples of anionic groups represented by X⊖ include a perchlorate, a fluoroborate, a sulfoacetate, an iodide, a chloride, a bromide, a p-toluenesulfonate, an alkylsulfonate (e.g., a methanesulfonate), an alkylsulfate (e.g., an ethylsulfate), an alkyldisulfonate (e.g., an ethanedisulfonate), a benzenedisulfonate (e.g., a 1,3-benzenedisulfonate), a halosulfonate (e.g., a chlorosulfonate), a picrate, a tetracyanoethylene anion, a tetracyanoquinodimethane anion, a benzotriazole-5-sulfonate, a 4-(2-methylthiotetrazole-1-yl) benzenesulfonate, an acetate, a benzoate, a sulfuric acid ion, an oxalate, a fumarate and a formate, which may form an inner salt when they are substitutents bonded to any group represented by A, $R_1$, $R_2$, $R_3$, $R_4$, $R_5$, $R_6$ or $R_7$.

Preferred organic groups represented by A are those represented by the following formulae (II) to (XIII):

Formula (II):

(II)

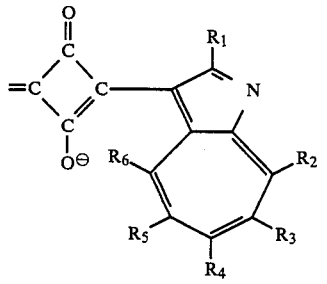

wherein $R_1$ to $R_6$ have the same meaning as defined in formula (I).

Formula (III)

(III)

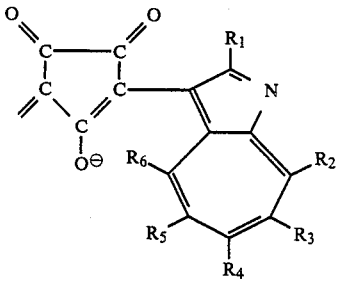

wherein $R_1$ to $R_6$ have the same meaning as defined in formula (I).

Formula (IV):

(IV)

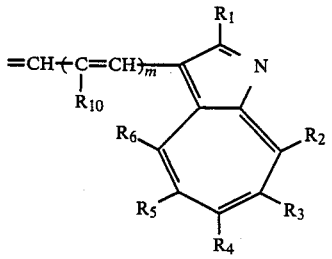

wherein $R_1$ to $R_6$ have the same meaning as defined in formula (I), $R_{10}$ represents a hydrogen atom, a nitro group, a cyano group, an alkyl group having 1 to 20 carbon atoms (e.g., methyl, ethyl, propyl and butyl), an aryl group having 6 to 20 carbon atoms (e.g., phenyl, tolyl, xylyl and dodecylphenyl) or an aralkyl group having 7 to 20 carbon atoms (e.g., benzyl, phenylethyl, methoxybenzyl and t-amylbenzyl) and m is 0, 1 or 2.

Formula (V):

(V)

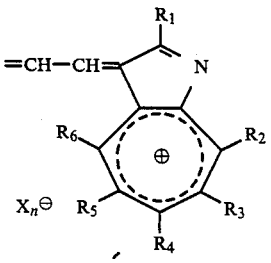

wherein $R_1$ to $R_6$, $X\ominus$ and n have the same meaning as defined in formula (I).

Formula (VI):

(VI)

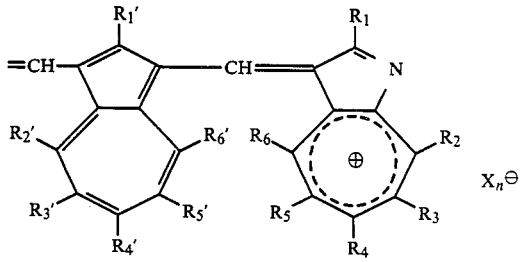

wherein $R_1$ to $R_6$, $X\ominus$ and n have the same meaning as defined in formula (I), $R_1'$ has the same meaning as $R_1$, and $R_2'$ to $R_6'$ have the same meaning as $R_2$ to $R_6$, respectively.

Formula (VII):

(VII)

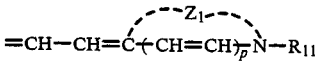

wherein $Z_1$ represents a non-metallic atomic group necessary for the forming a 5- or 6-membered heterocyclic ring, $R_{11}$ represents a substituted or unsubstituted alkyl group having 1 to 20 carbon atoms, preferably 1 to 6 carbon atoms, a substituted or unsubstituted aryl group having 6 to 30 carbon atoms, preferably 6 to 16 carbon atoms, a substituted or unsubstituted aralkyl group having 6 to 30 carbon atoms, preferably 6 to 16 carbon atoms, or an allyl group, and p is 0 or 1.

Of the heterocyclic rings formed by $Z_1$, preferred rings are nitrogen-containing heterocyclic rings such as pyridine, thiazole, benzothiazole, oxazole, benzoxazole, naphthoxazole, naphthothiazole, imidazole, benzimidazole, naphthoimidazole, 2-quinoline, 4-quinoline, isoquinoline, indole and indolenine; and these nitrogen-containing heterocyclic rings may be substituted with a halogen atom (e.g., F, Cl, Br and I), a substituted or unsubstituted alkyl group (e.g., a methyl group, an ethyl group, a sulfoethyl group, a sulfopropyl group, a sulfobutyl group, a hydroxyethyl group, a propynyl group, an isopropyl group, an octyl group, a hexadecyl group, a methoxyethyl group and a t-amyl group), a substituted or unsubstituted aryl group (e.g., a phenyl group, a tolyl group, a xylyl group, a chlorophenyl group and a methoxyphenyl group), a substituted or unsubstituted aralkyl group (e.g., a benzyl group, a 2-phenylethyl group, a 3-phenylpropyl group, an α-naphthylmethyl group, a methylbenzyl group, a chlorobenzyl group and a methoxybenzyl group), a substituted or unsubstituted alkoxy group (e.g., a methoxy group, an ethoxy group, a 4-sulfobutoxy group and a 3-sulfopropyl group), a nitro group, a hydroxy group or a carboxyl group.

Of these heterocyclic rings, particularly preferred are N-alkyl or N-substituted alkyl benzothiazole rings, N-alkyl or N-substituted alkyl benzimidazole rings, a 2- or 4-quinoline ring and an indole ring.

Formula (VIII):

$$=CH-R_{12} \qquad \text{(VIII)}$$

wherein $R_{12}$ represents a substituted or unsubstituted aryl group.

Particularly preferred groups represented by $R_{12}$ are substituted or unsubstituted phenyl groups having 6 to 20 carbon atoms or substituted or unsubstituted naphthyl groups having 10 to 30 carbon atoms. Examples of such groups include phenyl, tolyl, xylyl, biphenyl, α-naphthyl, β-naphthyl, methoxyphenyl, dimethoxyphenyl, trimethoxyphenyl, ethoxyphenyl, diethoxyphenyl, chlorophenyl, trichlorophenyl, bromophenyl, dibromophenyl, tribromophenyl, ethylphenyl, diethylphenyl, nitrophenyl, aminophenyl, dimethylaminophenyl, dibenzylaminophenyl, dipropylaminophenyl, morpholinophenyl, piperidinylphenyl, piperazinylphenyl, diphenylaminophenyl, acetylaminophenyl, benzoylaminophenyl, acetylphenyl, benzoylphenyl, cyanophenylmethanesulfonamidophenyl, di(2-hydroxyethyl) aminophenyl, N-ethyl-N-(2-methanesulfonamidoethyl-)aminophenyl, and 4-dimethylamino-2-methylphenyl.

Formula (IX):

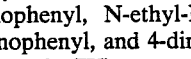

(IX)

wherein $R_{13}$ represents a monovalent group derived from a 5- or 6-membered heterocyclic ring. Preferred heterocyclic rings represented by $R_{13}$ are pyridine, thiazole, benzothiazole, oxazole, benzoxazole, naphthothiazole, naphthoxazole, imidazole, benzimidazole, naphthoimidazole, 2-quinoline, 4-quinoline, isoquinoline, indole, indolenine, furan, thiophene, benzofuran, thionaphthene, dibenzofuran, carbazole, phenothiazine, phenoxazine, 1,3,4-thiadiazole, 1,3,4-triazole, 1,3,4-oxadiazole and pyrazole, as well as substituted groups thereof.

Of these heterocyclic ring groups, particularly preferred groups are heterocyclic ring groups having up to 30 carbon atoms that may be substituted with a substituent such as a hyrdroxy group, a halogen atom (e.g., F, Cl, Br and I), a nitro group, a carboxyl group, a sulfonic acid group, a substituted or unsubstituted alkyl group having 1 to 20 carbon atoms (where the substituents include, for example, F, Cl, Br, I, a cyano group, a carboxyl group, a hydroxyl group, a sulfo group, an alkoxy group and a substituted or unsubstituted phenoxy group), a substituted or unsubstituted phenyl group having 6 to 20 carbon atoms (where the substituents include F, Cl, Br, I, a cyano group, a nitro group, a hydroxy group, a carboxyl group, a sulfo group, an alkoxy group, a sulfonamido group, a carbonamido group, a sulfamoyl group and a carbamoyl group), a carbonamido group, a sulfonamido group, a carbamoyl group, a sulfamoyl group, a carboxylic acid ester group and a ureido group.

Formula (X):

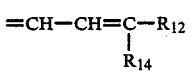

(X)

wherein $R_{14}$ represents a hydrogen atom, an alkyl group or an aryl group and $R_{12}$ has the same meaning as in formula (VIII).

Preferred groups represented by $R_{12}$ are the same as defined in formula (VIII). Preferred groups represented by $R_{14}$ include a hydrogen atom, an alkyl group having 1 to 20 carbon atoms (e.g., methyl, ethyl, propyl and butyl), a substituted or unsubstituted aryl group having 6 to 20 carbon atoms (e.g., phenyl, tolyl, xylyl, biphenyl, ethylphenyl, chlorophenyl, nitrophenyl, aminophenyl, dimethylaminophenyl, α-naphthyl, β-naphthyl, anthryl and pyrenyl).

Particularly preferred groups represented by $R_{14}$ include a hydrogen atom, an alkyl group having 1 to 17 carbon atoms, and a substituted or unsubstituted phenyl group having 6 to 20 carbon atoms.

Formula (XI):

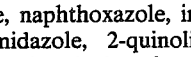

(XI)

wherein $R_{12}$ has the same meaning as in formula (VIII).

Formula (XII):

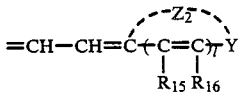

(XII)

wherein $Z_2$ represents an atomic group necessary for forming an optionally substituted pyran, thiapyran, selenapyran, benzopyran, benzothiapyran, benzoselenapyran, naphthopyran, naphthothiapyran, naphthoselenapyran, tellurapyran, benzotellurapyran or naphthotellurapyran ring; l is 0, 1 or 2, $R_{15}$ and $R_{16}$, which may be the same or different, each represents a hydrogen atom, an alkyl group, an alkoxy group, an aryl group, a styryl group, a 4-phenyl-1,3-butadienyl group or a heterocyclic ring group that may have a substituent; and Y represents O, S or Se.

In formula (XII), $Z_2$ preferably represents an atomic group necessary for forming a pyran ring, a thiapyran ring, a benzopyran ring or a benzothiapyran ring; l is 1 or 2; Y represents O or S; and each of $R_{15}$ and $R_{16}$ independently represents a hydrogen atom; a straight or branched chain or cyclic alkyl group having 1 to 20 carbon atoms; a substituted or unsubstituted phenyl group having 6 to 20 carbon atoms (where the substituents include F, Cl, Br, I, an alkyl group, an alkoxy group, a carbonamido group, a carbamoyl group, a sulfonamido group, a sulfamoyl group, a ureido group and a carboxylic acid ester group); a substituted or unsubstituted styryl group having 8 to 20 carbon atoms (e.g., styryl, p-methylstyryl, o-chlorostyryl or p-methoxystyryl); or a substituted or unsubstituted 5- or 6-membered heterocyclic ring group (e.g., quinolyl, pyridyl, furyl, carbazolyl, imidazolyl, thiazolyl, oxazolyl, benzimidazolyl, benzothiazolyl, benzoxazolyl, 1,3,4-thiazolyl, 1,3,4-oxadiazolyl and 1,3,4-triazolyl).

Formula (XIII):

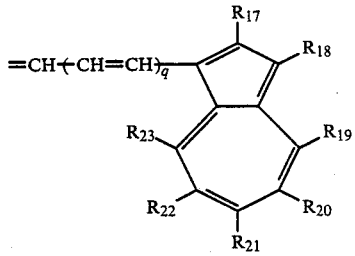

(XIII)

wherein $R_{17}$, $R_{18}$, $R_{19}$, $R_{20}$, $R_{21}$, $R_{22}$ and $R_{23}$, which may be the same or different, each represents a hydrogen atom, a halogen atom, a hydroxyl group, a nitro group, a carboxyl group, a sulfonic acid group, a mercapto group, or a monovalent organic group, and q is an integer of 0, 1 or 2; provided that any two of $R_{17}$, $R_{18}$, $R_{19}$, $R_{20}$, $R_{21}$, $R_{22}$ and $R_3$ bonded to adjacent carbon atoms may be linked to form a substituted or unsubstituted aromatic carbocyclic or aromatic heterocyclic ring.

Examples of azaazulenium salt compounds used in the present invention are given below, but the present invention is not to be construed as being limited thereto.
Examples of compounds represented by Formula (II):
(1)
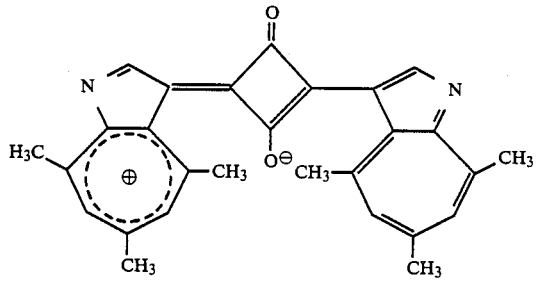
(2)
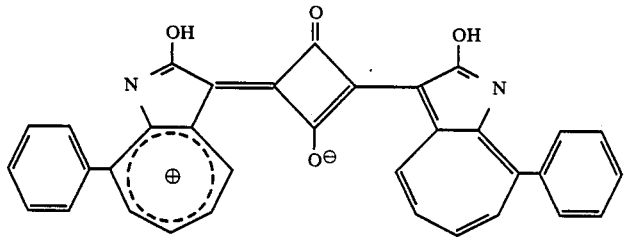
(3)
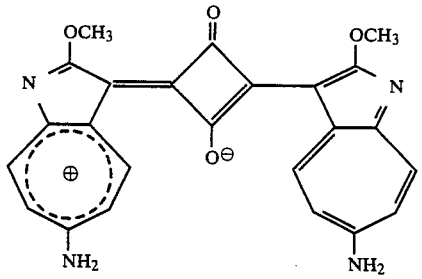
(4)
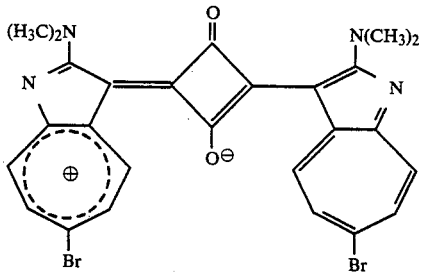
(5)
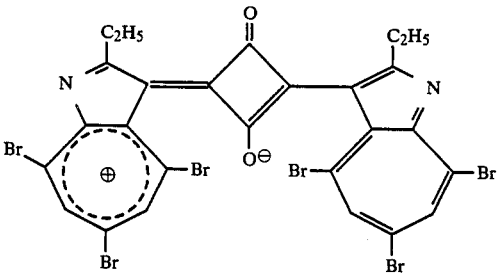
(6)
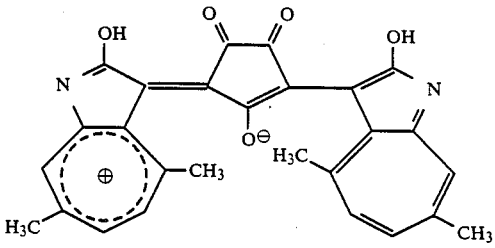
Examples of compounds represented by Formula (III):

-continued
(7)
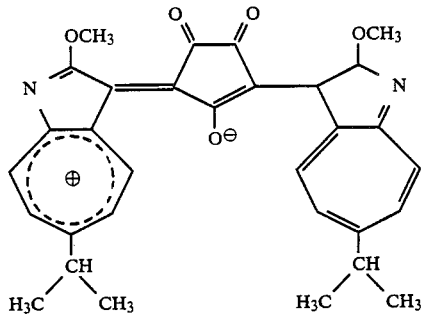
(8)
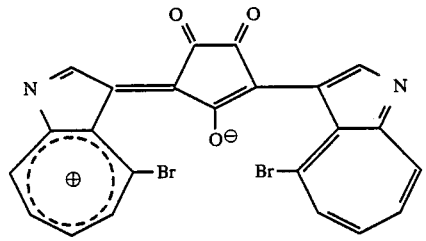
Examples of compounds represented by Formula (IV):
(9)
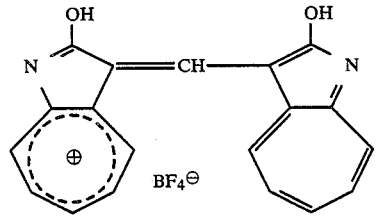
(10)
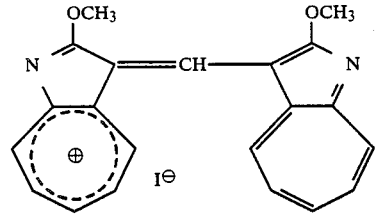
(11)
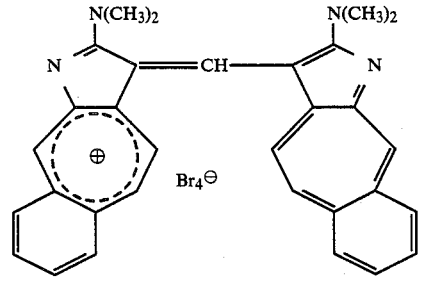
Examples of compounds represented by Formula (V):
(12)
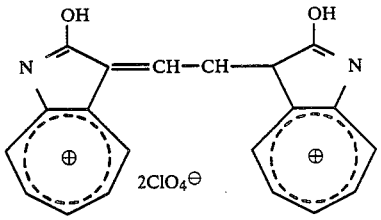
(13)
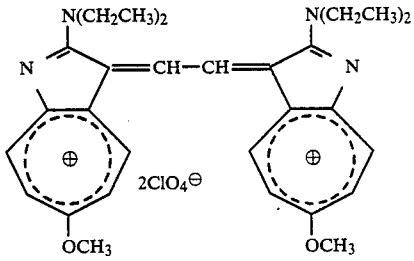
Examples of compounds represented by Formula (VI):
(14)
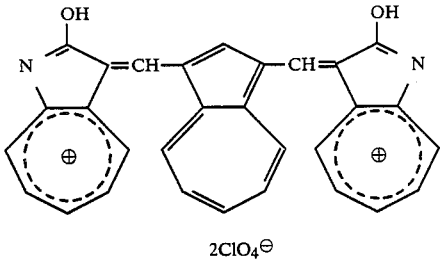
(15)
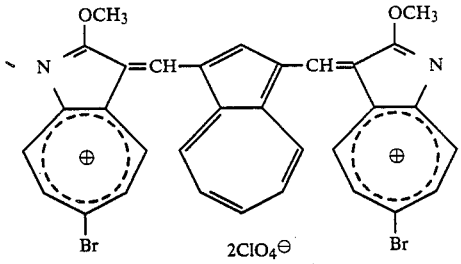
(16)
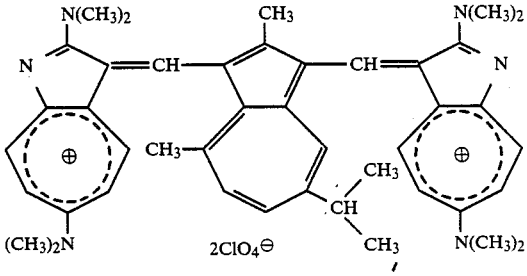
Examples of compounds represented by Formula (VII):

(17)
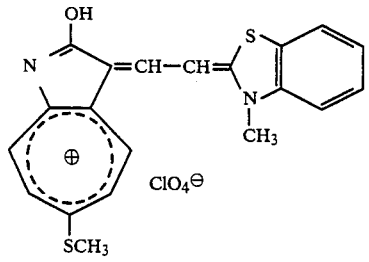
(18)
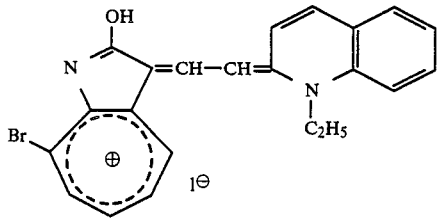
(19)
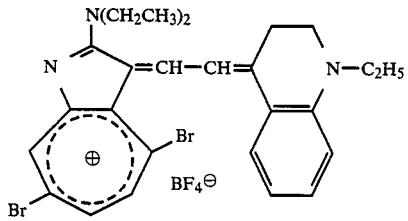
(20)
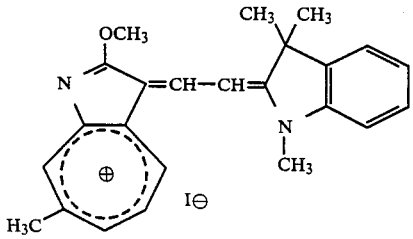
(21)
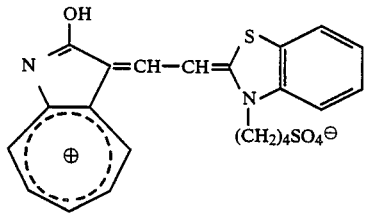
Examples of compounds represented by Formula (VIII):
(22)
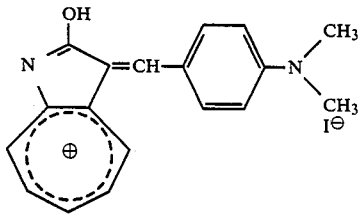
-continued
(23)
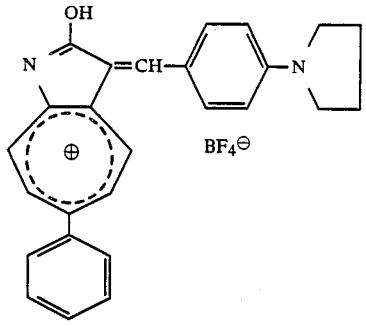
(24)
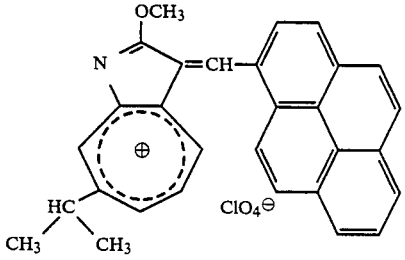
(25)
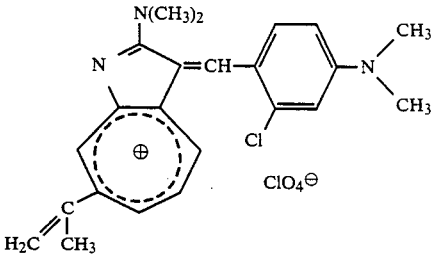
(26)
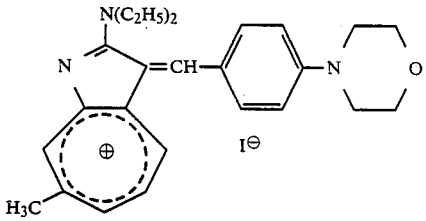
Examples of compounds represented by Formula (IX):
(27)
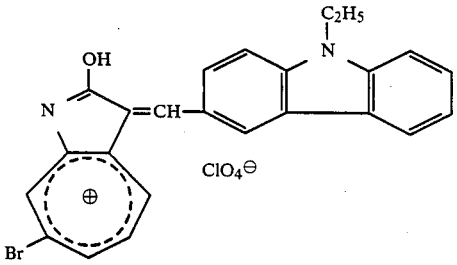

-continued
(28)
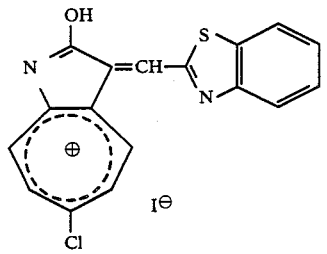
(29)
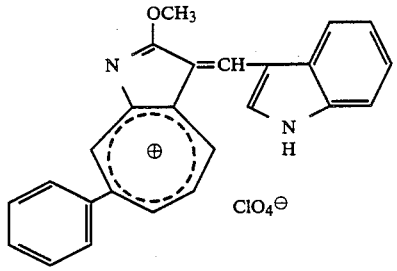
(30)
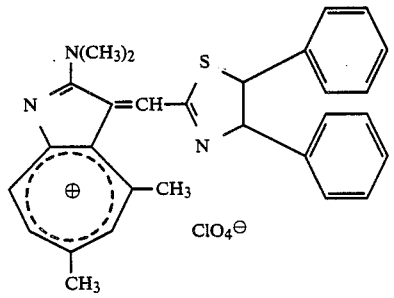
Examples of compounds represented by Formula (X):
(31)
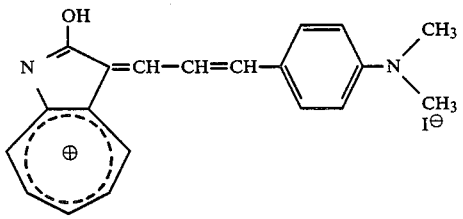
(32)
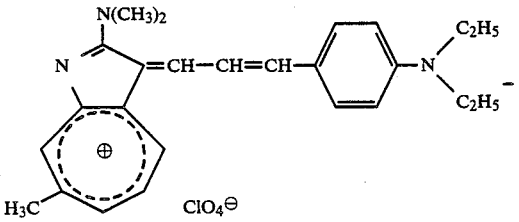
(33)
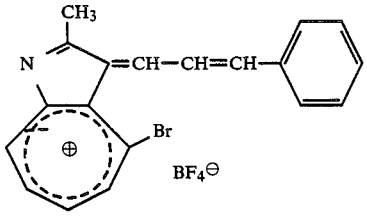
-continued
(34)
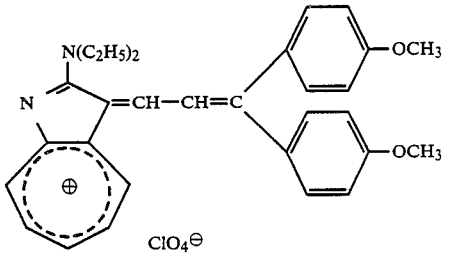
(35)
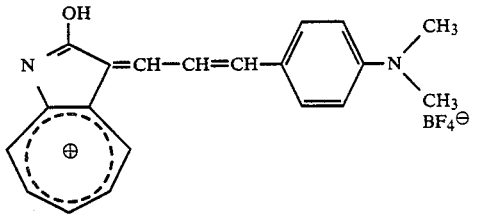
(36)
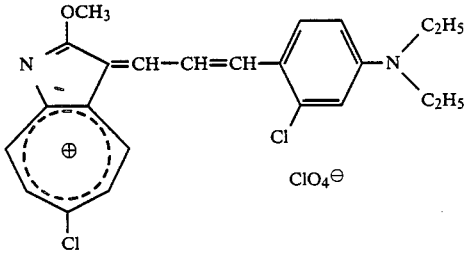
(37)
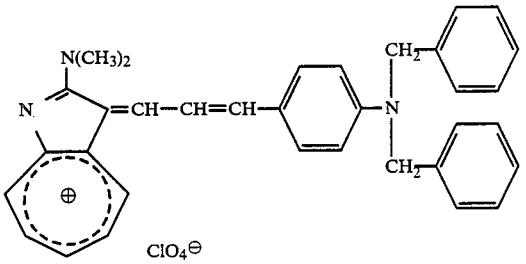
Examples of compounds represented by Formula (XI):
(38)
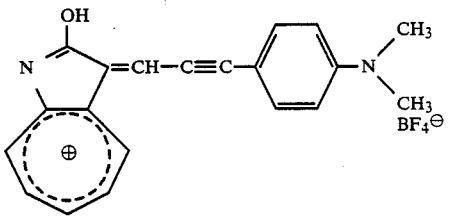
(39)
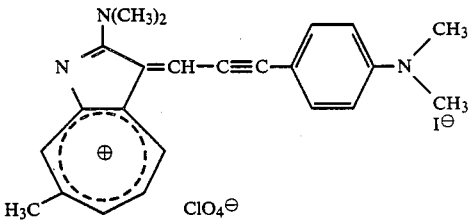

Examples of compounds represented by Formula (XII):

(40)

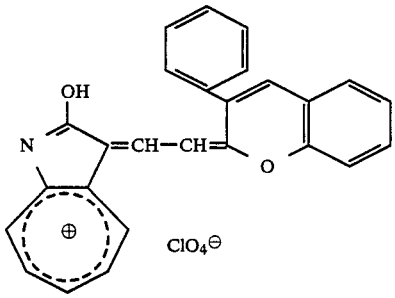

(41)

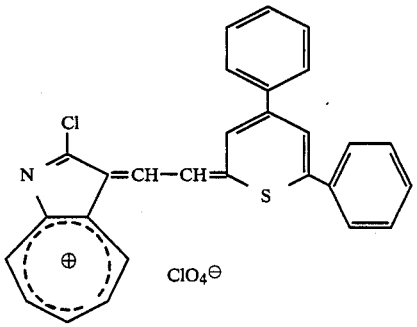

(42)

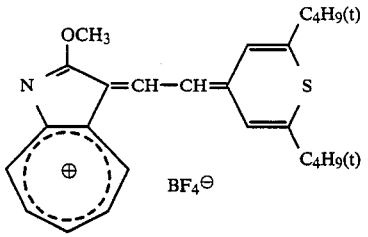

(43)

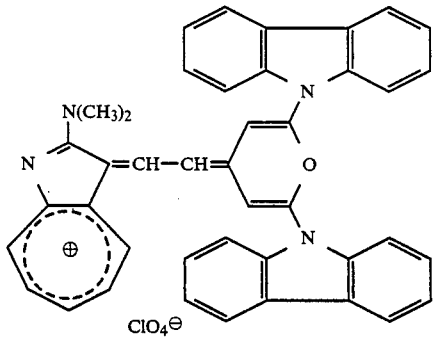

Examples of compounds represented by Formula (XIII):

(44)

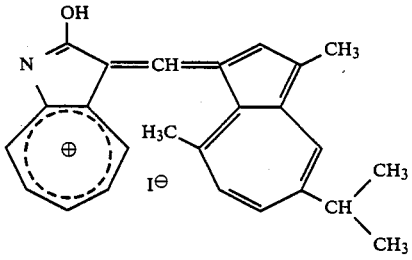

-continued (45)

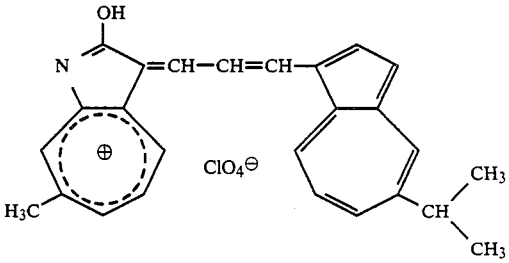

(46)

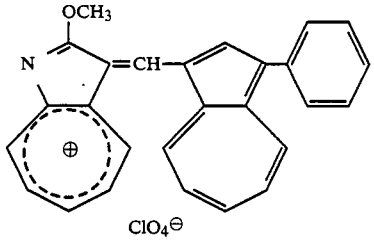

(47)

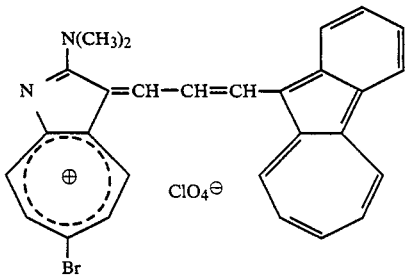

Of compounds represented by formula (I), compounds having an A moiety represented by formula (II) and (III) can be produced in the similar manner as described in *Angewandte Chemie,* Vol. 78, No. 20, page 937 (1966), by reacting an azaazulene compound with squalic acid or croconic acid in a suitable solvent. (Azaazulene compounds can be synthesized by the method described by Nozoe in *Chemistry and Industry,* pages 1357–1358 (1954).

Compounds having an A moiety represented by formula (IV) wherein m=0 can be obtained by using, instead of 1-formylazulene compounds and azulene compounds described in *Journal of the Chemical Society,* pages 494–501 (1960), the respective corresponding azaazulene compounds, and carrying out the reaction in a suitable solvent in the presence of a strong acid; or as described in *Journal of the Chemical Society,* pages 1724–1730 (1961), by reacting 1-ethoxymethyleneazulenium salts and, instead of azulene compounds, the corresponding azaazulene compounds in a suitable solvent; or as described in *Journal of the Chemical Society,* page 359 (1961), by heating 2-hydroxymethylenecyclohexanone with an azaazulene compound in a suitable solvent in the presence of a strong acid.

Compounds represented by formula (IV) wherein m=1 and m=2 can be produced in accordance with the description in *Journal of the Chemical Society,* pages 3579–3592 (1961), by mixing azaazulene compounds with malondialdehydes or glutacondialdehydes in a suitable solvent in the presence of a strong acid. Compounds having an A moiety represented by formula (V) can be readily obtained by heating azaazulene compounds with glyoxal in a suitable solvent in the presence of a strong acid in accordance with the description in *Journal of the Chemical Society*, pages 3579–3588 (1961). Compounds having an A moiety represented by formula (VI) can be obtained by heating 3-diformylazulene compounds and azaazulene compounds in a suitable solvent in the presence of a strong acid in accordance with the description in *Journal of the Chemical Society*, pages 494–501 (1960).

Compounds having an A moiety represented by formula (VII) can be obtained by heating 3-formylazaazulene compounds and heterocyclic quaternary ammonium salt compounds having an active methylene group in a suitable solvent in accordance with the description in *Journal of the Chemical Society*, pages 163–167 (1961).

Compounds having an A moiety represented by formulae (VIII), (IX), (X) and (XI) can be obtained by reacting azaazulene compounds with corresponding aldehyde compounds in a suitable solvent in the presence of a strong acid in accordance with the descriptions in *Journal of the Chemical Society*, pages 1110–1117 (1958), *Journal of the Chemical Society*, pages 494–501 (1960) and *Journal of the Chemical Society*, pages 3579–3593 (1961).

Compounds having an A moiety represented by formula (XII) can be obtained by reacting 3-formylazaazulene compounds with compounds represented by formula (XIV) in a solvent.

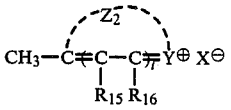

(XIV)

wherein $Z_2$, Y, $R_{15}$, $R_{16}$ and $X^{\ominus}$ and l have the same meaning as defined in formula (XII).

Solvents used in these synthesis reactions include alcohols such as ethanol, butanol and benzyl alcohol, nitriles such as acetonitrile and propionitrile, organic carboxylic acids such as acetic acid, acid anhydrides such as acetic anhydride, and cycloaliphatic ethers such as dioxane and tetrahydrofuran. A mixture of butanol or benzyl alcohol with an aromatic hydrocarbon such as benzene or toluene can also be used. The temperature during the reaction may range from room temperature to the boiling point of the solvent used.

Compounds having an A moiety represented by formula (XIII) can be obtained by reacting 1-formylazulene compounds with azaazulene compounds in a suitable solvent in the presence of a strong acid in accordance with the description in *Journal of the Chemical Society*, pages 494–501 (1960).

An electrophotographic photoreceptor using the photoconductive composition of this invention (hereinafter referred to as "electrophotographic photoreceptor") has an electrophotographic photosensitive layer containing one or more of the azaazulenium salt compounds represented by formula (I).

Various forms of electrophotographic photoreceptors have been known. The electrophotographic photoreceptors of the present invention may be in any of the known forms but usually have configurations of the types described below.

(a) Electrophotographic photoreceptors comprising an electrically conductive support provided thereon with an electrophotographic photosensitive layer having an azaazulenium salt compound dispersed in a binder or an electric charge carrier transporting medium.

(b) Electrophotographic photoreceptors comprising an electrically conductive support provided thereon with an electric charge carrier generating layer mainly comprising an azaaulenium salt compound on which an electric charge carrier transporting medium layer is provided.

The azaazulenium salt compounds of the present invention act as photoconductive materials. Those compounds generate electric charge carriers at an extremely high efficiency upon absorption of light. The electric charge carriers thus generated can be transported through those azaazulenium salt compounds as medium. However, it is more efficient to use an electric charge carrier transporting compound as a medium for transporting the electric charge carriers.

The electrophotographic photoreceptors of the type (a) can be prepared by dispersing particulate azaazulenium salt compound into a binder solution or a solution of an electric charge carrier transporting compound and a binder, applying the disperison onto an electrically conductive support, and then drying the coating. The thickness of the electrophotographic photosensitive layer thus prepared is generally from 3 to 30 μm, preferably from 5 to 20 μm.

The electrophotographic photoreceptors of the type (b) can be prepared by vacuum-depositing an azaazulenium salt compound on an electrically conductive support, applying a solution of an azaazulenium salt compound in an appropriate solvent on an electrically conductive support, or applying a dispersion of particulate azaazulenium salt compound in a suitable solvent, or, if necessary, a solvent containing a binder dissolved therein on an electrically conductive support, drying the coating, and then applying a solution containing an electric charge carrier transporting compound and a binder onto the coating, which is then dried. The thickness of the azaazulenium salt compound layer as an electric charge carrier generating layer is generally 4 μm or less, and preferably 2 μm or less. The thickness of the elctric charge transporting medium layer is generally from 3 to 30 μm, preferably from 5 to 20 μm.

The azaazulenium salt compounds used for the photoreceptors of the types (a) and (b) are crushed by means of a suitable dispersion mixer such as ball mill, sand mill, or vibration mill, so that the average particle diameter thereof is reduced to 5 μ or less, and preferably 2 μm or less.

If the amount of the azaazulenium salt compound used in the electrophotographic photoreceptors of the type (a) is too small, the photosensitivity of the product is poor. On the contrary, if it is too large, the chargeability of the photosensitive layer is poor and the strength of the electrophotographic photosensitive layer is low. The content of the azaazulenium salt compound in the electrophotographic photosensitive layer is generally from 0.01 to 2 times by weight, and preferably from 0.05 to 1 time by weight, the weight of the binder. The content of the electric charge carrier transporting compound which is added to the receptors as necessary is from 0.1 to 2 times by weight, and preferably from 0.3 to 1.3 times by weight, the weight of the binder. If the electric charge carrier transporting compound which can be used as a binder itself is used, the added amount of the azaazulenium salt compound is preferably from 0.01 to 0.5 times by weight the weight of the binder.

If an azaazulenium salt compound-containing layer is applied on a support to form an electric charge carrier generating layer in the electrophotographic photoreceptors of the type (b), the amount of the azaazulenium salt compound used is preferably 0.1 times or more by weight the weight of the binder resin. If this amount is less than the above value, a sufficient photosensitivity cannot be obtained. The content of the electric charge carrier transporting compound in the electric charge transporting medium is generally from 0.2 to 2 times by weight, and preferably from 0.2 to 1.3 times by weight, the weight of the binder. If a high molecular weight electric charge carrier transporting compound which itself can be used as a binder is used, other binders are not necessary.

In preparation of the photoreceptors of the type (b), an electric charge carrier transporting compound such as hydrazone compounds and oxime compounds may be added to the electric charge generating layer as described in Japanese Patent Application (OPI) Nos. 196767/85, 254045/85 and 262159/85.

In preparation of the electrophotographic photoreceptors of the present invention, additives such as plasticizer and sensitizer may be added together with the binder.

An electrically conductive support used in the electrophotographic photoreceptors of the present invention there may be employed metal plates of aluminum, copper, zinc or the like, plastic sheet or plastic film of polyester or the like having an electrically conductive material such as aluminum, indium oxide and $SnO_2$ vacuum-deposited or disperion-coated thereon, or paper treated with an electrically conductive material.

As the binder there may be preferably employed a hydrophobic, electrically insulating film forming high molecular weight polymer having a high dielectric constant. Examples of such a high molecular weight polymer may include the following compounds. However, the present invention is not limited to these compounds.

Polycarbonate, polyester, polyester carbonate, methacrylate resin, acrylate resin, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinyl-carbazole.

These binders may be used singly or in the form of a mixture of two or more such binders.

Examples of the plasticizers include biphenyl, biphenyl chloride, o-terphenyl, p-terphenyl, dibutyl-phthalate, dimethylglycolphthalate, dioctylphthalate, triphenylphosphoric acid, methylnaphthalene, benzophenone, chlorinated paraffin, paraffin polypropylene, polystyrene, dilaurylthiodipropionate, 3,5-dinitro-salicylic acid, fluorohydrocarbons and the like.

Alternatively a silicone oil or the like may be added to improve the surface characteristics of the electrophotographic photoreceptors. As the sensitizers there may be employed chloranil, tetracyanoethylene, Methyl Violet, Rhodamine B, a cyanine dye, a merocyanine dye, a pyrylium dye, and thiapyrylium.

Electric charges carrier transporting compounds are classified into two types of compounds, i.e., compounds for transporting electrons and compounds for transporting positive holes. The electrophotographic photoreceptors of the present invention may employ both the two types of compounds. Examples of such electron transporting compounds include compounds having electron withdrawing groups, such as 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazolechloranile, 2,3-dichloro-5,6-dicyanobenzoquinone, 2,4,7-trinitro-9,10-phenanthrenequinone, tetrachlorophthalic anhydride, tetracyanoethylene, and tetracyanoquinodimethane.

Examples of the positive hole transporting compounds include compounds having electron donative groups. If such compounds are high moelcular weight compounds, examples include:

(1) Polyvinylcarbazoles and derivatives thereof as described in Japanese Patent Publication No. 10966/59.

(2) Vinyl polymers such as polyvinyl pyrene, polyvinyl anthracene, poly-2-vinyl-4-(4'-dimethylamino-phenyl) -5-phenyloxazole, and poly-3-vinyl-N-ethylcarbazole described in Japanese Patent Applicatin Nos. 18674/68 and 19192/68.

(3) Polymers such as polyacenaphthylene, polyindene, and a copolymer of acenaphthylene and styrene described in Japanese Patent Publication No. 19193/68.

(4) Condensaton resins such as pyrene-formaldehyde resin, bromopyrene-formaldehyde resin, and ethylcarbazole-formaldehyde resin described in Japanese Patent Publication No. 13940/81.

(5) Various triphenylmethane polymers as described in Japanese Patent Appication (OPI) Nos. 90883/81 and 161550/81.

If such compounds having electron donative groups are low molecular weight compounds, examples include:

(6) Triazole derivatives as described in U.S. Pat. No. 3,112,197.

(7) Oxadiazole derivatives as described in U.S. Pat. No. 3,189,447.

(8) Imidazole derivatives as described in Japanese Patent Publication No. 16096/62.

(9) Polyarylalkane derivatives described in U.S. Pat. Nos. 3,615,402, 3,820,989 and 3,542,544, Japanese Patent Publication Nos. 555/70 and 10983/76, Japanese Patent Application (OPI) Nos. 93224/76, 108667/80, 156953/80 and 36656/81.

(10) Pyrazoline derivatives and pyrazolone derivatives as described in U.S. Pat. Nos. 3,180,729 and 4,278,746, Japanese Patent Application (OPI) Nos. 88064/80, 88065/80, 105537/74, 51086/80, 80051/81, 88141/81, 45545/82, 112637/79 and 74546/80.

(11) Phenylenediamine derivatives as described in U.S. Pat. No. 3,615,404, Japanese Patent Publication No. 10105/76, Japanese Patent Application (OPI) Nos. 83435/79, 110836/79 and 119925/79, Japanese Patent Publication Nos. 3712/71 and 28336/72.

(12) Arylamine derivatives as described in U.S. Pat. No. 3,567,450, Japanese Patent Publication No. 35702/74, West German Patent (DAS) No. 1,110,518, U.S. Pat. Nos. 3,180,703, 3,240,597, 3,658,520, 4,232,103, 4,175,961 and 4,012,376, Japanese Patent Application (OPI) Nos. 144250/80 and 119132/81, Japanese Patent Publication No. 27577/64, Japanese Patent Application (OPI) No. 22437/81.

(13) Amino-substituted chalcone derivatives as described in U.S. Pat. No. 3,526,501.

(14) N,N-Bicarbazile derivatives as described in U.S. Pat. No. 3,542,546.

(15) Oxazole derivatives as described in U.S. Pat. No. 3,257,203.

(16) Styrylanthracene derivatives as described in Japanese Patent Application (OPI) No. 46234/81.

(17) Fluorenone derivatives as described in Japanese Patent Application (OPI) No. 110837/79.

(18) Hydrazone derivatives as described in U.S. Pat. No. 3,717,462, Japanese Patent Application (OPI) Nos. 59143/79 (corresponding to U.S. Pat. No. 4,150,987), 52063/80, 52064/80, 46760/80, 85495/80, 11350/82, 148749/82 and 104144/82.

(19) Benzidine derivatives as described in U.S. Pat. Nos. 4,047,948, 4,047,949, 4,265,990, 4,273,846 4,299,897 and 4,306,008.

(20) Stilbene derivatives as described in Japanese Patent Application (OPI) Nos. 190953/83, 95540/84, 97148/84 and 195658/84.

However, the electric charge carrier transporting compounds of the present invention are not limited to the above compounds (1) to (20), and any known electric charge carrier transporting compound can be employed.

These electric charge carrier transporting materials may optionally be used in any combination of two or more such materials.

The photoreceptors thus obtained optionally may comprise an adhesive layer or a barrier layer provided interposed between the electrically conductive support and the photosensitive layer. As materials used for such an adhesive layer or barrier layer there may be employed gelatin, casein, polyvinyl alcohol, ethyl cellulose, carboxymethyl cellulose, vinylidene chloride polymer latex as described in Japanese Patent Application (OPI) No. 84247/84, styrene-butadiene polymer latex as described in Japanese Patent Application (OPI) No. 114544/84, and aluminum oxide besides the high molecular weight polymers used for the above binder. The thickness of the layers are preferably 1 μm or less.

Thus, we have discussed the electrophotographic photoreceptors of the present invention in detail. The electrophotographic photoreceptors of the present invention are generally characterized by high photosensitivity and excellent durability.

The electrophotographic photoreceptors of the present invention find wide application in fields ranging from electrophotographic copying machines to printers using a laser or cathode ray tube as a light source.

The photoconductive composition containing an azaazulenium salt compound of the present invention can be used as a photoconductive layer for video camera tube or a photoconductive layer for solid pickup elements having a light receiving layer provided on the entire surface of a one-dimensionally or two-dimensionally arranged semiconductor circuit for performing signal transfer or scanning. The present photoconductive composition can be also used for a photoconductive layer for solar battery as described in *Journal of Applied Physics*, Vol. 49, No. 12, page 5982 (1978), by A. K. Chosh and Tom Feng.

The azaazulenium salt compound of the present invention can be also used as a photoconductive colored particle for photoelectrophoretic system as described by R. M. Schaffert, *Electrophotography*, 2nd Ed., 1975, p. 136, or a colored particle for dry or wet electrophotographic developer.

The azaazulenium salt compound of the present invention can be used to produce a printing plate or printed circuit, e.g., as follows. The azaazulenium salt compound of the present invention is dispersed into an alkali-soluble resin liquid such as phenol resin together with the above electric charge carrier transporting compound such as oxadiazole derivatives and hydrazone derivatives as described in Japanese Patent Publication No. 17162/62 and Japanese Patent Application (OPI) Nos. 19063/80, 161250/80 and 147656/82. The dispersion thus obtained is applied on an electrically conductive support such as aluminum, dried, imagewise exposed, developed with a toner, and etched with an aqueous solution of alkali to produce a printing plate or printed circuit having a high resolving power, excellent durability, and high photosensitivity.

The present invention is further illustrated with reference to the following Synthesis Examples and Examples, which are for the purpose of illustration only and are not to be construed as limiting the invention. Unless otherwise indicated, all parts, percents and ratios are by weight.

SYSNTHESIS EXAMPLE 1

Synthesis of Exemplified Compound (22)

4 g of 4-N,N-dimethylbenzaldehyde, 4.1 g of cyclohepta[b]pyrrole2-(1H)-one (hereinafter referred to as 1-azaazulanone) and 4.14 g of sodium iodide were dissoved in 100 ml of methanol. 5.3 g of p-toluenesulfonic acid monohydrate was added to the solution and the mixture was heated for 1 hour with stirring. After allowing the mixture to cool to room temperature, the resulting product was filtered, and washed with 100 ml of methanol and 100 ml of acetone, followed by drying to obtain 4.4 of the azaazulenium salt (yield: 37%; melting point: over 280° C.).

Visible Absorption Spectrum (in acetonitrile)

Absorption maximum wavelength: 618 nm

| | Analysis | | | |
|---|---|---|---|---|
| | C | H | N | I |
| Calc'd for $C_{18}H_{17}N_2IO$ (%): | 53.48 | 4.24 | 6.93 | 31.39 |
| Found (%): | 53.64 | 4.09 | 6.90 | 31.21 |

SYNTHESIS EXAMPLE 2

Synthesis of Exemplified Compound (31)

8.75 g of 4-N,N-dimethylcinnamaldehyde and 7.25 g of 1-azaazulanone were dissolved in 200 ml of ethanol. Then, 22.5 g of 57% hydriodic acid was added dropwise to the solution and after the mixture was stirred for 1 hour at room temperature, the mixture was heated for 4 hours under reflux. After allowing the mixture to cool at room temperature, the resulting product was filtered and washed with 100 ml of methanol and 100 ml of acetone, followed by drying. 9.35 g of the azaazulenium salt was obtained (yield; 45%; melting point: over 280° C.).

Visible Absorption Spectrum (in acetonitrile)

Absorption maximum wavelength: 721 nm

| | Analysis | | | |
|---|---|---|---|---|
| | C | H | N | I |
| Calc'd for $C_{20}H_{19}N_2IO$ (%): | 55.83 | 4.45 | 6.51 | 29.49 |
| Found (%): | 55.96 | 4.49 | 6.28 | 29.20 |

EXAMPLE 1

1 part of Azaazulenium Salt Compound (31) synthesized in Synthesis Example 2, 5 parts of 4,4'-bis-(diethylamin)-2,2'-dimethyltriphenylmethane and 5 parts of polycarbonate of bisphenol A (Lexan 121, a product of GE Company) were added to 95 parts of dichloromethane, and were ground and stirred in a ball mill to form a coating liquid. The coating liquid was applied onto an electroconductive transparent support (obtained by depositing a film of indium oxide on the surface of a polyethylene terephthalate film 100 μm in thickness and with a surface resistance of $10^3\Omega$) by using a wire round rod, followed by drying to prepare an electrophotographic photoreceptor having a single layer tape electrophotographic photosensitive layer of about 8 μm thickness.

The resulting electrophotographic photoreceptor was charged with +400 V by corona discharge at +5 kV in a static manner by using an electrostatic copy paper testing apparatus (Model SP-428, a product of Kawaguchi Denki K. K.), and the amount of exposure required for attenuating the electric potential to half, that is, the half decay exposure amount $E_{50}$ (erg/cm$^2$) was measured. As a light source a gallium/aluminum-/arsenic semiconductor laser (oscillating wavelength: 780 nm) was used. The result was $E_{50}$ = 10.2 erg/cm$^2$.

EXAMPLES 2–7

Example 1 was repeated, with the exception that, instead of Compound (31) synthesized in Synthesis Example 2, the azaazulenium salt compounds shown in Table 1 were used to prepare single-layered electrophotographic photoreceptors, and the half decay exposure amount $E_{50}$ was measured in the same manner as described in Example 1 using positive charging. The results obtained are shown in Table 1 below.

TABLE 1

| Example No. | Azaazulenium Salt Compound No. | $E_{50}$ (erg/cm$^2$) |
|---|---|---|
| 2 | (4) | 15.8 |
| 3 | (10) | 30.2 |
| 4 | (14) | 11.7 |
| 5 | (22) | 20.8 |
| 6 | (27) | 16.3 |
| 7 | (44) | 17.4 |

EXAMPLE 8

5 parts of Azaazulenium Salt Compound (4) were dispersed in a solution of 5 parts of polyester resin (molecular weight: about 20,000; Vylon 200, a product of Toyo Spinning Co., Ltd.) in 50 parts of tetrahydrofuran using a ball mill for 20 hours, and the dispersion was applied onto an electroconductive support (that was obtained by depositing an aluminum film on the surface of a polyethylene terephthalate film 75 μm in thickness and with a surface resistance of $4\times10^2\Omega$) by using a wire round rod, followed by drying to prepare a charge generating layer of 0.5 μm thickness.

Then, a solution of 3.6 parts of p-(diphenylamino) benzaldehyde N'-methyl-N'-phenylhydrazone

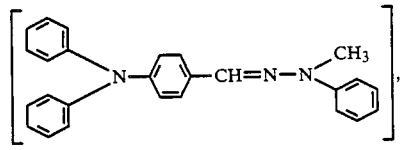

4 parts of polycarbonate of bisphenol A (trade name: Panlite K-1300, a product of Teijin Limited) in 13.3 parts of dichloromethane, and 26.6 parts of 1,2-dichloroethane was applied onto the charge generating layer by using a wire round rod, followed by drying to form a charge transporting layer of 11 μm thickness, to obtain an electrophotographic photoreceptor having an electrophotographic layer containing the two layers.

The resulting electrophotographic photoreceptor was charged with corona discharge at -6 kV for 2 seconds using an electrostatic copy paper testing apparatus (Model SP-428, a product of Kawaguchi Denki K. K.). Then, the initial surface electric potential $V_o$ was measured, and, after it was allowed to stand in the dark for 30 seconds, the electric potential $V_s$ was measured. Then, the electrophotographic photoreceptor was exposed to light by using a gallium/aluminum/arsenic semiconductor laser (oscillating wavelength: 780 nm) as a light source. In this case, the amount of exposure required for attenuating the electric potential $V_s$ (obtained after allowing to stand in the dark for 30 seconds) to half, that is, the half decay exposure amount $E_{50}$ (erg/cm$^2$) was measured. The results were as follows:

$V_o$: —-630 V $V_s$: —-550 V $E_{50}$: 25.4 erg/cm$^2$

The same measurement was repeated 3,000 times. The results showed that $V_o$, $V_s$ and $E_{50}$ varied quite little (-610 V, -530 V and 25.9 erg/cm$^2$, respectively), demonstrating that the photoreceptor had good repeating characteristics.

EXAMPLES 9–21

Example 8 was repeated, except that the azaazulenium salt compounds shown in Table 2 were used instead of Azaazulenium Salt Compound (4) to produce two-layered electrophotographic photoreceptors, and the half decay exposure amount $E_{50}$ was measured in the same manner as described in Example 8. The results are shown in Table 2.

TABLE 2

| Example No. | Bisazulenium Salt Compound No. | $E_{50}$ (erg/cm$^2$) |
|---|---|---|
| 9 | (2) | 12.5 |
| 10 | (6) | 9.3 |
| 11 | (9) | 8.8 |
| 12 | (14) | 6.5 |
| 13 | (18) | 12.0 |
| 14 | (22) | 11.7 |
| 15 | (23) | 13.5 |
| 16 | (27) | 10.5 |
| 17 | (31) | 5.8 |
| 18 | (35) | 7.0 |
| 19 | (38) | 8.8 |
| 20 | (40) | 15.3 |
| 21 | (45) | 7.5 |

With respect to the electrophotographic photoreceptors, the measurement was repeated 3,000 times in the same manner as described in Example 8, and it was found that $V_o$, $V_s$ and $E_{50}$ varied quite little, demonstrating that the electrophotographic photoreceptors were quite excellent in stability.

EXAMPLE 22

5 parts of Azaazulenium Salt Compound (31) obtained in Synthesis Example 2, 40 parts of the hydrazone compound used in Example 8 and 110 parts of a copolymer of methacrylic acid with benzyl methacrylate ([η] 30° C. methyl ethyl ketone: 0.12, the methacrylic acid content: 32.9%) were added to 660 parts of dichloromethane, and were dispered therein by using ultrasonic wave That dispersion was applied onto an aluminum plate having a thickness of 0.25 mm, the surface of which had been roughened, followed by drying to prepare an electrophotographic printing plate precursor having an electrophotographic layer with a dry-film thickness of 6 μm.

Then, after the sample was subjected to corona discharge (+6 kV) in the dark so that the surface electric potential of the photosensitive layer was about +600 V, the sample was exposed to light using a gallium-/aluminum/arsenic semiconductor laser (oscillating wavelength: 780 nm), and the half decay exposure amount was determined to be 10.3 erg/cm$^2$.

Then, after the surface electric potential of the sample was charged to about +400 V in the dark, it was brought into firm contact with a transparent original having a positive image and was exposed to light imagewise, using a gallium/aluminum/arsenic semiconductor laser (the oscillating wavelength: 780 nm) as a light source. Then, it was dipped into a liquid developing solution containing a toner prepared by adding 0.01 part of soybean lecithin and 5 parts of finely divided and dispersed polymethyl methacrylate (toner) into 1,000 parts of Isoper H (a petroleum type solvent produced by Esso Standard Co.) to obtain a clear positive toner image.

The toner image was fixed by heating at 100° C. for 30 seconds. The printing plate material was dipped for about 1 minute in a solution containing 70 parts of sodium metasilicate hydrate in 140 parts of glycerin, 550 parts of ethylene glycol and 150 parts of ethanol, and was washed in water stream with brushing lightly to remove the part of the electrophotographic layer where the toner did not adhere, thereby to obtain a printing plate.

A similarly obtained latent electrostatic image was also subjected to magnetic brush development (instead of the developing liquid) using a toner for Xerox 3500 (a product of Fuji Xerox C., Ltd.) and was fixed by heating to 80° C. for 30 seconds. Then, the part of the photosensitive layer where the toner did not adhere was removed using an alkaline solution, to obtain a printing plate.

The printing plates thus prepared were used for ordinary printing by a Hamada Star 600 CD offset printing machine. As a result, 50,000 sheets of clear prints free of stain were obtained.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising at least one azaazulenium salt represented by the following formula (I):

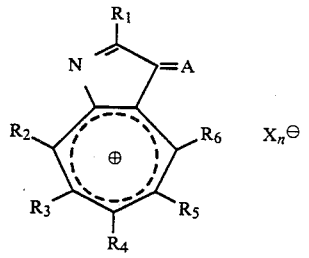

(I)

wherein $R_1$, $R_2$, $R_3$, $R_4$, $R_5$ and $R_6$, which may be the same or different, each represents a hydrogen atom, a halogen atom, a hydroxyl group, a nitro group, a carboxyl group, a sulfonic acid group, a mercapto group, or a monovalent organic group; A represents a divalent organic group bonded by the double bond; X⊖ represents an anionic group; n is the number of X⊖ groups required to balance the positive charge; provided that each X⊖ group may be bonded to any of $R_1$, $R_2$, $R_3$, $R_4$, $R_5$, $R_6$ or A to form an inner salt; and any two of $R_2$, $R_3$, $R_4$, $R_5$ and $R_6$ bonded to adjacent carbon atoms may be linked to form a substituted or unsubstituted aromatic carbocyclic or aromatic heterocyclic ring.

2. The photoconductive composition as claimed in claim 1, wherein said monovalent organic group contains from 1 to 30 carbon atoms and is selected from the group consisting of a substituted or unsubstituted alkyl group, a substituted or unsubstituted aryl group, a substituted or unsubstituted heterocyclic ring group, a substituted or unsubstituted aralkyl group, an acyl group, a substituted or unsubstituted amino group, a substituted or unsubstituted styryl group, a substituted or unsubstituted alkoxy group, a substituted or unsubstituted alkylthio group, a substituted or unsubstituted arylthio group, a substituted or unsubstituted heterocyclic thio group, a substituted or unsubstituted carbamoyl group, a substituted or unsubstituted alkoxycarbonyl group, a substituted or unsubstituted aryloxycarbonyl group, and a substituted or unsubstituted arylazo group.

3. The photoconductive composition as claimed in claim 2, wherein $R_1$ represents a hydrogen atom; a hydroxyl group; a halogen atom; a substituted or unsubstituted alkyl group containing 1 to 20 carbon atoms; a substituted or unsubstituted alkoxy group containing 1 to 10 carbon atoms; a substituted or unsubstituted phenyl group containing 6 to 20 carbon atoms; a substituted or unsubstituted amino group; or —$OCOR_7$, wherein $R_7$ represents a substituted or unsubstituted alkyl group, a substituted or unsubstituted aryl group or a substituted or unsubstituted aralkyl group; or a substituted or unsubtituted amino group.

4. The photoconductive composition as claimed in claim 2, wherein $R_2$, $R_3$, $R_4$, $R_5$ and $R_6$ each represents a hydrogen atom, a halogen atom, a substituted or unsubstituted alkyl group containing 1 to 20 carbon atoms, or a substituted or unsubstituted phenyl group containing 6 to 20 carbon atoms; and X⊖ represents a perchlorate, a fluoroborate, a sulfoacetate, an iodide, a chloride, a bromide, a p-toluenesulfonate, an alkylsulfonate, an alkylsulfate, an alkyldisulfonate, a benzenedisulfonate, a halosulfonate, a picrate, a tetracyanoethylene anion, a benzotriazole-5-sulfonate, a 4-(2-methylthiotetrazole-l-yl) benzenesulfonate, an acetate, a benzoate, a sulfuric acid ion, an oxalate, a fumarate or a formate.

5. The photoconductive composition as claimed in claim 2, wherein said divalent organic group A is represented by the following formula (II):

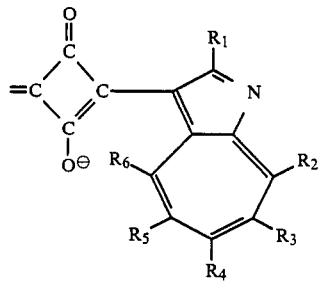

(II)

wherein $R_1$ to $R_6$ each has the same meaning as in formula (I).

6. The photoconductive composition as claimed in claim 1, wherein said divalent organic group A is represented by the following formula (III):

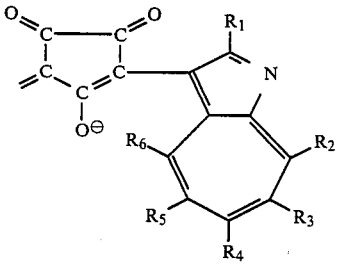

(III)

wherein $R_1$ to $R_6$ each has the same meaning as in formula (I).

7. The photoconductive composition as claimed in claim 1, wherein said divalent organic group A is represented by the following formula (IV):

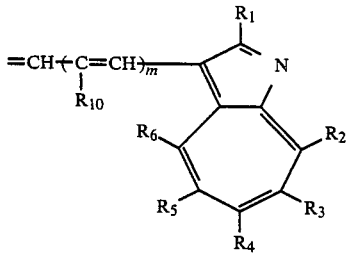

(IV)

wherein $R_1$ to $R_6$ each has the same meaning as in formula (I); $R_{10}$ represents a hydrogen atom, a nitro group, a cyano group, an alkyl group containing 1 to 20 carbon atoms, an aryl group containing 6 to 20 carbon atoms, or an aralkyl group containing 7 to 20 carbon atoms; and m is 0, 1 or 2.

8. The photoconductive composition as claimed in claim 1, wherein said divalent organic group A is represented by the following formula (V):

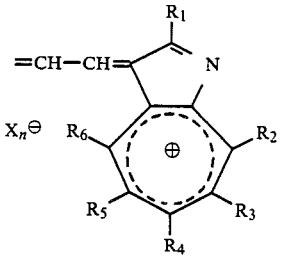

(V)

wherein $R_1$ to $R_6$, $X\ominus$ and n each has the same meaning as in formula (I).

9. The photoconductive composition as claimed in claim 1, wherein said divalent organic group A is represented by the following formula (VI):

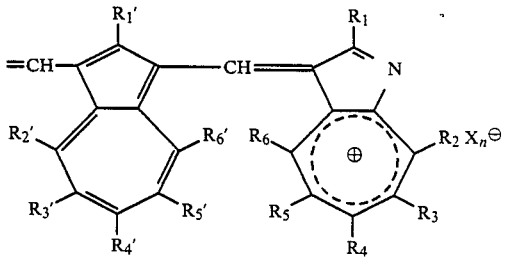

(VI)

wherein $R_1$ to $R_6$, $X\ominus$ and n each has the same meaning as in formula (I); $R_1'$ has the same meaning as $R_1$ in formula (I); and $R_2'$ to $R_6'$ each has the same meaning as $R_2$ to $R_6$, respectively, in formula (I).

10. The photoconductive composition as claimed in claim 1, wherein said divalent organic group A is represented by the following formula (VII):

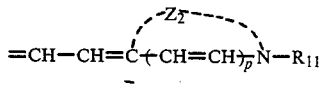

(VII)

wherein $Z_1$ represents a non-metallic atomic group necessary for forming a 5-membered or 6-membered heterocyclic ring; $R_{11}$ represents a substituted or unsubstituted alkyl group, a substituted or unsubstituted aryl group, a substituted or unsubstituted aralkyl group or an allyl group; and p is 0 or 1.

11. The photoconductive composition as claimed in claim 10, wherein said heterocyclic ring including $Z_1$ is a nitrogen-containing heterocyclic ring that is unsubstituted or substituted with a halogen atom, a substituted or unsubstituted alkyl group, a substituted or unsubstituted aryl group, a substituted or unsubstituted aralkyl group, a substituted or unsubstituted alkoxy group, a nitro group, a hydroxyl group, or a carboxyl group.

12. The photoconductive composition as claimed in claim 11, wherein said heterocyclic ring is an N-alkyl benzothiazole ring, an N-substituted alkyl benzothiazole ring, an N-alkyl benzimidazole ring, an N-substituted alkyl benzimidazole ring, a 2-quinoline ring, a 4-quinoline ring, or an indole ring.

13. The photoconductive composition as claimed in claim 1, wherein said divalent organic group A is represented by the following formula (VIII):

$$=CH-R_{12} \qquad \text{(VIII)}$$

wherein $R_{12}$ represents a substituted or unsubstituted aryl group.

14. The photoconductive composition as claimed in claim 13, wherein $R_{12}$ represents a substituted or unsubstituted phenyl group containing 6 to 20 carbon atoms, or a substituted or unsubstituted naphthyl group containing 10 or 30 carbon atoms.

15. The photoconductive composition as claimed in claim 1, wherein said divalent organic group A is represented by the following formula (IX):

$$=CH-R_{13} \quad \text{(IX)}$$

wherein $R_{13}$ represents a monovalent group comprising a 5-membered or 6-membered heterocyclic ring.

16. The photoconductive composition as claimed in claim 1, wherein said divalent organic compound A is represented by the following formula (X):

$$=CH-CH=\underset{\underset{R_{14}}{|}}{C}-R_{12} \quad \text{(X)}$$

wherein $R_{14}$ represents a hydrogen atom, an alkyl group or an aryl group and $R_{12}$ represents a substituted or unsubstituted aryl group.

17. The photoconductive composition as claimed in claim 1, wherein said divalent organic group A is represented by the following formula (XI):

$$=CH-C\equiv C-R_{12} \quad \text{(XI)}$$

wherein $R_{12}$ represents a substituted or unsubstituted aryl group.

18. The photoconductive composition as claimed in claim 1, wherein said divalent organic compound A is represented by the following formula (XII):

$$=CH-CH=\overset{\overset{Z_2}{\frown}}{C}\left(\underset{\underset{R_{15}}{|}}{C}=\underset{\underset{R_{16}}{|}}{C}\right)_l Y \quad \text{(XII)}$$

wherein $X_2$ represents an atomic group necessary for forming a substituted or unsubstituted heterocyclic ring selected from pyran, thiapyran, selenapyran, benzopyran, benzothiapyran, benzoselenapyran, naphthopyran, napthothiapyran, naphthoselenapyran, tellurapyran, benzotellurapyran and naphthotellurapyran; l is 0, 1 or 2; $R_{15}$ and $R_{16}$, which may be the same or different, each represents a hydrogen atom, an alkyl group, an alkoxy group, an aryl group, a styryl group, a 4-phenyl-1,3-butadienyl group, or a substituted or unsubstituted heterocyclic ring group; and Y represents O, S or Se.

19. The photoconductive composition as claimed in claim 1, wherein said divalent organic group A is represented by the following formula (XIII):

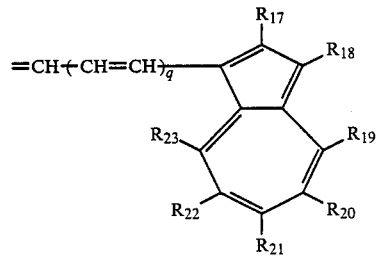

(XIII)

wherein $R_{17}$, $R_{18}$, $R_{19}$, $R_{20}$, $R_{21}$, $R_{22}$ and $R_{23}$, which may be the same or different, each represents a hydrogen atom, a halogen atom, a hydroxyl group, a nitro group, a carboxyl group, a sulfonic acid group, a mercapto group, or a monovalent organic group, and q is an integer of 0, 1 or 2; provided that any two of $R_{17}$, $R_{18}$, $R_{19}$, $R_{20}$, $R_{21}$, $R_{22}$ and $R_{23}$ bonded to adjacent carbon atoms may be linked to form a substituted or unsubstituted aromatic carbocyclic or aromatic heterocyclic ring.

* * * * *